US005177812A

United States Patent [19]

DeMars

[11] Patent Number: 5,177,812

[45] Date of Patent: Jan. 12, 1993

[54] ILLUMINATED ARTICLE OF WEARING APPAREL

[76] Inventor: Robert A. DeMars, 23221 Ladrillo Ave., Woodland Hills, Calif. 91367

[21] Appl. No.: 926,283

[22] Filed: Aug. 10, 1992

[51] Int. Cl.[5] ..... A42B 1/24

[52] U.S. Cl. ..... 2/199; 2/209.2; 362/105

[58] Field of Search ..... 2/196, 199, 209.1, 209.2; 362/103, 104, 105, 106, 107, 108

[56] References Cited

U.S. PATENT DOCUMENTS

| | | | |
|---|---|---|---|
| 2,747,196 | 5/1956 | Kaye | 2/199 |
| 4,061,910 | 12/1977 | Rosenfeld | 362/104 |
| 4,652,981 | 3/1987 | Glynn | 362/103 |
| 4,665,568 | 5/1987 | Stutes | 2/199 |
| 4,839,777 | 6/1989 | Janko | 362/108 |
| 4,875,144 | 10/1989 | Wainwright | 362/103 |
| 4,901,211 | 2/1990 | Shen | 362/105 |
| 4,998,186 | 3/1991 | Cocca | 362/105 |

*Primary Examiner*—Andrew M. Falik
*Assistant Examiner*—Diana L. Biefeld
*Attorney, Agent, or Firm*—Jack C. Munro

[57] ABSTRACT

The including of an engaging recess with an article of human being wearing apparel, such as a cap, that has a specific exterior ornamental configuration. An elongated illuminatable light tube is to be snapped into an elongated groove formed on the wearing apparel and is to be snugly retained thereby. The light tube is to be flexible so as to accommodate to the specific shape of groove. The illuminatable tube includes a substance which is to be activatable which will cause the tube to glow for a period of time.

4 Claims, 1 Drawing Sheet

ILLUMINATED ARTICLE OF WEARING APPAREL

BACKGROUND OF THE INVENTION

1) Field of the Invention

The field of this invention is directed to wearing appararel and more particularly to wearing apparel which can be selectively illuminated for a period of time.

2) Description of Prior Art

The use of wearing apparel that has a specific exterior ornamental configuration has long been known. One common type of such wearing apparel is headwear. There are numerous types of hats, caps, beenies and so forth. At times, headwear may be cause to represent a particular desired configuration such as "Mickey Mouse ears".

Ornamental wearing apparel such as headwear is frequently sold within certain environments as a novelty item. Such environments would be in theme parks. Generally, children are the principal users of such headwear and the more attractive such headwear can be manufactured the greater the enducement for the child to purchase and use the headwear.

Within recent years, a new type of novelty item that has become of common use within recreational facilities, such as theme parks, is what is frequently referred to as a glow tube. The glow tube is an elongated plastic thin tube which can be readily bent in any desired configuration. Within the interior of the glow tube there is incorporated an activatable substance. Upon the glow tube being manually grasped and rapidly bent back and forth, this substance is activated and light is emitted. This emitting of light causes the tube to glow and the tube will continue to glow for a period of time such as generally four to eight hours.

Prior to the present invention, it has not been known to incorporate a glow tube in conjunction with an article of wearing apparel of a specific ornamental configuration such as is commonly used in conjunction with theme parks where glow tubes are commonly sold.

SUMMARY OF THE INVENTION

The structure of the present invention is directed to an article of wearing apparel such as headwear. This headwear is to have a specific exterior configuration. Within the outline of the ornamental configuration of the headwear there is included an elongated groove. The size of this groove is adapted to snugingly receive a glow tube. The user is to purchase the headwear and then purchase a light activatable glow tube and after activating of the glow tube mount such in conjunction with the groove which thereby causes the headwear to be illuminated. The headwear is then to be worn by the user.

The primary objective of the present invention is to construct a new type of novelty item which will be attractive to a particular type of user such as children.

Another objective of the present invention is to combine together two known types of novelty items which will then produce a newer and third type of novelty item which has heretofore been unknown.

Another objective of the present invention is to construct a novelty item which can be manufactured inexpensively and which will then be sold to the ultimate consumer at an inexpensive price.

DETAILED DESCRIPTION OF THE SHOWN EMBODIMENT

Figure 1:
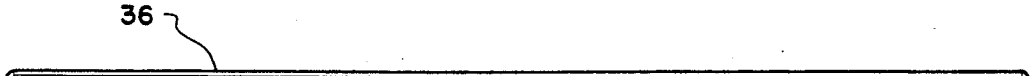
FIG. 1 is a side view of a conventional illuminatable tube which is to be usable in conjunction with the wearing apparel of the present invention showing the illuminatable tube in an unilluminated configuration.
Figure 2:
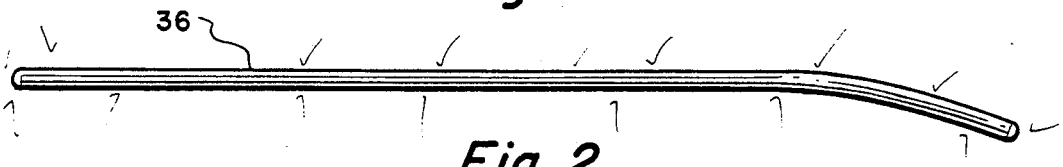
FIG. 2 is a view similar to FIG. 1 but showing the tube in the illuminated configuration and also showing the tube in a slightly bent configuration.
Figure 3:
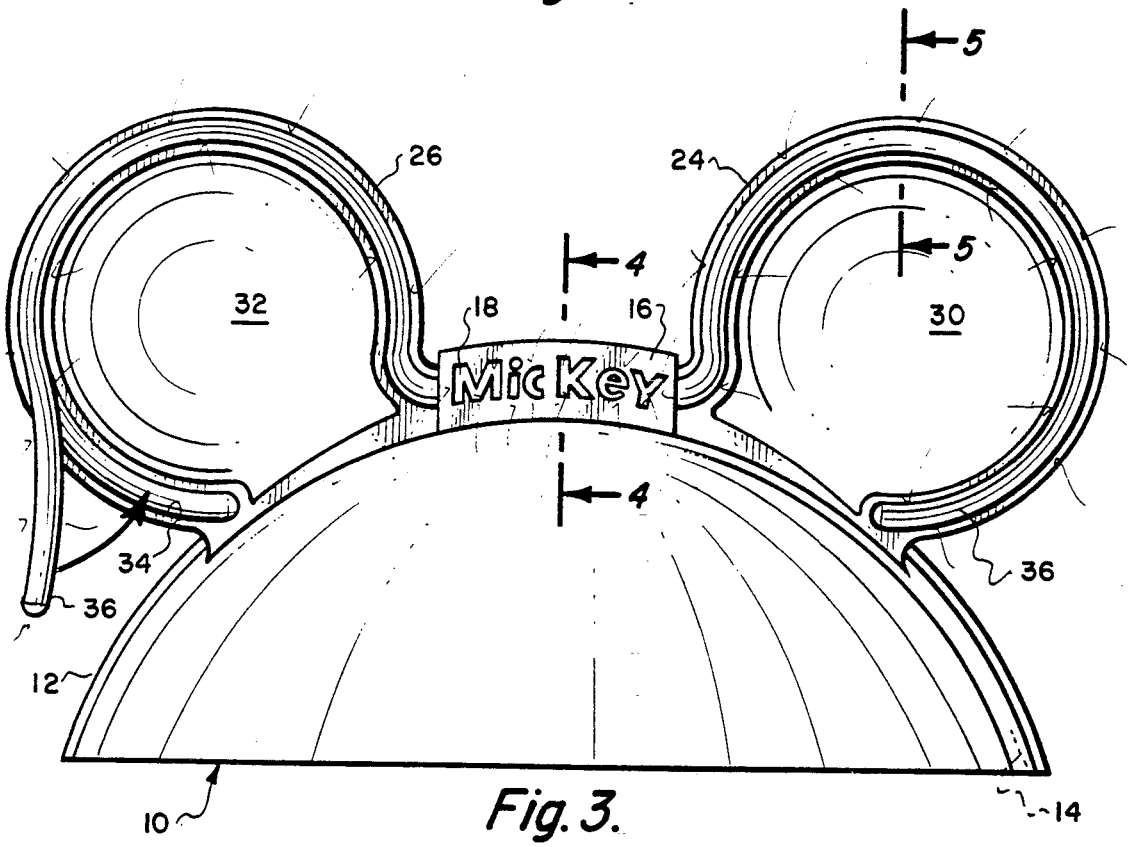
FIG. 3 is a front view of a typical article of wearing apparel within which has been incorporated the illuminatable tube.
Figure 4:
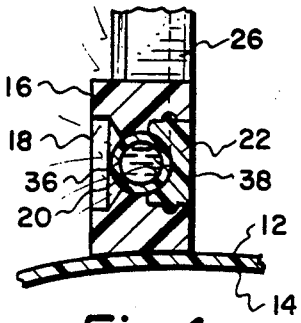
FIG. 4 is a cross-sectional view through a portion of the headwear taken along line 4—4 of FIG. 3 showing the utilizing of a portion of the illuminatable tube to illuminate indicia.
Figure 5:
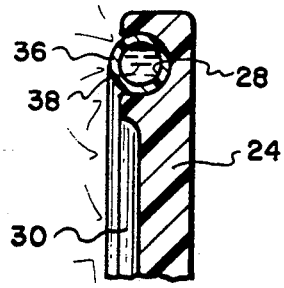
FIG. 5 is a cross-sectional view through another portion of the wearing apparel of FIG. 3 taken along line 5—5 of FIG. 3.

It is to be understood that the structure of the present invention is shown in conjunction with headwear and particularly in conjunction with a particular type of novelty headwear. However, it is considered to be within the scope of this invention that the concept of this invention could be utilized with other types of headwear as well as other types of wearing apparel for human beings. For example, it is believed that the structure of this invention could be incorporated within other rigid wearing apparel such as belts and shoes.

Referring particularly to the drawing, there is shown a headwear 10 which has a particular type of exterior configuration. This headwear 10 includes a cap 12 which has a hollow internal chamber 14. The human head (not shown) is to be located within the internal chamber 14. Exteriorly of the cap 12 and centrally mounted thereon there is a block 16. The block 16 has a front surface within which is formed a series of letters 18. It is to be understood that the letters 18 could be another form of indicia such as an insignia.

The block 16 includes a through groove 20. Within the back surface of the block 16 there is formed a flared recess 22. The flared recess 22 connects with the groove 20. The flared recess 22 is to facilitate insertion of a section of an illuminatable light tube 36. The light tube 36 is to be manually pressed through the flared recess 22 to snappingly engage the groove 20 in a snug manner. This illuminatable light tube 36 is to be made of plastic and has a hollow interior within which is located a quantity of a chemically liquid substance 38. The substance 38 is to be activated by bending or otherwise deforming of the tube 36 which will cause the substance 38 to luminesce. This light emission will then cause illumination of the lettered indicia 18. The activatable substance is proprietary to the manufacturer of the glow tube 36.

The obtaining of chemiluminescent light is the reaction of a catalyzed hydrogen peroxide solution with a fluorescer solution. Blue, green and yellow chemiluminescent light has been produced depending upon the particular fluorescer employed in the fluorescer solution. Examples of these prior art chemiluminescent light-systems can be found in one or more of the following U.S. Pat. Nos. 3,749,679; 3,391,068; 3,391,069; 3,974,368; 3,557,233; 3,597,362; 3,775,336; 3,888,786.

Integrally attached to the cap 12 on one side of block 16 is a thin plate-like configuration 24. Fixedly mounted also on the exterior surface of the cap 12 on the opposite side of the block 16 is another plate-like configuration 26 which is essentially identical to configuration 24. Configurations 24 and 26 are to represent the ears of a "Mickey Mouse hat".

Within the front surface of the ear 24 is formed an enlarged depression 30. A similar such enlarged depression 32 is formed within the front surface of the ear 26. Formed within the front surface of the ear 24 along the peripheral edge thereof is a groove 28. A similar such groove 34 is formed within the front surface of the ear 26 along its peripheral edge thereof. The size of the grooves 28 and 34 are identical and are to be used to snugly retain the light tube 36 which is snapped therewithin. The light tube 36 is to be manually activated so as to emit light and then manually inserted within groove 34, groove 20 and groove 28. As the headwear 10 is then used, the outline of the ornamental configuration of the headwear 10 is illuminated by the illuminating tube 36. It is to be understood that the tube 36, when it no longer illuminates, can be removed and a new tube 36 inserted if such is deemed to be desired.

What is claimed is:

1. An article of wearing apparel comprising:

a housing, said housing adapted to fit onto a portion of the body of a human being, said housing having a specific ornamental exterior configuration; an elongated illuminating tube, said elongated illuminating tube being flexible to permit bending to any desired configuration, said elongated illuminating tube including an activatable substance, said activatable substance being selectibly activatable so as to emit light for a period of time; and connection means formed on said housing, said connection means securely engaging said elongated illuminating tube, said connection means comprising an elongated groove, said elongated illuminating tube snappingly engagable with said elongated groove, said elongated illuminating tube being removable from said elongated groove, said activable substance being activated to cause said elonagated illuminating tube to glow, said tube being engaged with said housing and said housing being capable of being worn by the human being.

2. The article wearing apparel as defined in claim 1 wherein:

said elongated groove outlines said specific ornamental exterior configuration.

3. The article wearing apparel as defined in claim 2 wherein:

said housing includes indicia, said elongated groove connecting with said indicia, said elongated illuminating tube causing illumination of said indicia.

4. The article wearing apparel as defined in claim 3 wherein:

said article of wearing apparel comprises headwear.

* * * * *